US011034535B2

(12) United States Patent
Burkart

(10) Patent No.: US 11,034,535 B2
(45) Date of Patent: Jun. 15, 2021

(54) SADDLE STITCHER FOR PRINTED PRODUCTS

(71) Applicant: Mueller Martini Holding AG, Hergiswil (CH)

(72) Inventor: Martin Burkart, Wohlen (CH)

(73) Assignee: Mueller Martini Holding AG, Hergiswil (CH)

( * ) Notice: Subject to any disclaimer, the term of this patent is extended or adjusted under 35 U.S.C. 154(b) by 153 days.

(21) Appl. No.: 16/517,687

(22) Filed: Jul. 22, 2019

(65) Prior Publication Data

US 2020/0031597 A1 Jan. 30, 2020

(30) Foreign Application Priority Data

Jul. 25, 2018 (CH) ..... 00920/18

(51) Int. Cl.
*B42C 1/12* (2006.01)
*B65H 5/02* (2006.01)
*B65H 37/04* (2006.01)

(52) U.S. Cl.
CPC ..... *B65H 5/023* (2013.01); *B42C 1/12* (2013.01); *B65H 37/04* (2013.01); *B65H 2301/142* (2013.01); *B65H 2301/4479* (2013.01); *B65H 2404/6591* (2013.01)

(58) Field of Classification Search
USPC ..... 270/52.16, 52.18, 52.26, 52.29
See application file for complete search history.

(56) References Cited

U.S. PATENT DOCUMENTS 4,482,141 A 11/1984 Moser
4,499,834 A * 2/1985 Ruetschle ..... B65H 29/62 112/2
4,518,156 A * 5/1985 Moser ..... B65H 5/32 198/470.1
6,378,865 B1 * 4/2002 Brotherston ..... B65H 5/023 198/575
6,994,337 B1 * 2/2006 Cracknell ..... B26D 1/08 270/52.26
7,628,389 B2 * 12/2009 Steinert ..... B42B 4/00 270/52.14

(Continued)

FOREIGN PATENT DOCUMENTS

EP 1593526 A2 11/2005
WO WO 0134403 A2 5/2001
WO WO 2008019101 A2 2/2008

*Primary Examiner* — Leslie A Nicholson, III
(74) *Attorney, Agent, or Firm* — Leydig, Voit & Mayer, Ltd.

(57) ABSTRACT

A saddle stitcher for printed products includes a saddle chain; a stitching machine; a controller; an ejector; and a delivery system. The delivery system includes: at least one lower conveyor belt and one upper conveyor belt; and at least one deflection roller for the lower conveyor belt, the at least one deflection roller being arranged in a radius. The lower conveyor belt has a first controllable self-propelled drive. The upper conveyor belt has a second controllable self-propelled drive. The controller is configured to separately control the first controllable self-propelled drive and the second controllable self-propelled drive. The controller is configured to provide a control that is exact to a cycle and is adjustable according to a thickness and a format of a respective printed product in a product flow.

13 Claims, 2 Drawing Sheets

(56) References Cited

U.S. PATENT DOCUMENTS

| | | | | |
|---|---|---|---|---|
| 7,660,556 | B2 * | 2/2010 | Saitsu | B42C 19/02 399/407 |
| 8,047,522 | B2 * | 11/2011 | Silberbauer | B42C 11/045 270/52.18 |
| 2005/0249575 | A1 | 11/2005 | Steinert et al. | |

* cited by examiner

SADDLE STITCHER FOR PRINTED PRODUCTS

CROSS-REFERENCE TO PRIOR APPLICATIONS

Priority is claimed to Swiss Patent Application No. CH 00920/18, filed on Jul. 25, 2018, the entire disclosure of which is hereby incorporated by reference herein.

FIELD

The invention relates to a saddle stitcher for printed products.

BACKGROUND

With digital printing, each brochure can feature a different number of sheets; and therefore, each brochure can be of various thicknesses. A combined system is also possible; that is, a part of the brochure can come from traditionally printed sheet sections, such as gravure printing, offset printing, etc., and an additional part can come from digital printing.

In the printing industry, terms such as "Print _4.0" or "Web to Print" are associated with the topic "Industry 4.0," which means that, for printing presses, run sizes=1 must also be processed. Thus, Industry 4.0 printing presses should be able to meet the following requirements: (1) that there is communication with higher-level systems that provide the necessary data; and (2) that the machines are designed so that the necessary settings can be made on-the-fly and for each production cycle.

The assembled brochures, consisting of folded sheet sections placed on top of each other, are transported by the saddle chain to the stitching station, where they are stitched in the fold.

The following is a list of definitions of relevant terms used herein:

- Printed product: Finished printed product consisting of at least one or more sheet sections (newspaper, booklet, magazine, catalog).
- Stitching machine: Stitches a brochure consisting of one or more sheets by means of a staple.
- Sheet: Paper printed on both sides.
- Sheet sections: Multiple sheets (usually printed differently).
- Saddle chain: Horizontal continuous conveyor unit for sheet sections.
- Digital printing: Sheets are printed directly in the production process and combined into a brochure; each brochure can contain a different number of sheets and thus affect the thickness of the brochure.
- Variable in thickness: The thickness of the printed products, which are processed in cycles, is variable; that is, they can have different thicknesses.
- Cutting device: Cutting system that has a front knife and two side knives and performs the cutting process, consisting of a front cut and a head/foot cut as a subsequent cut.
- Product feed: Mechanical device for transporting a printed product from the delivery system of the stitching station up to the cutting device.
- Saddle stitcher: In a saddle stitcher, several sheets are typically collected on a transport chain, stitched in the stitching station, and cut on three sides in the cutting device.

- Cutting apparatus: Cutting system that has a front knife and two side knives and performs the cutting process, consisting of a front cut and a head-foot cut as a subsequent cut.
- Saddle chain: The saddle chain has a guide device, the upper section of which is formed to be blade-shaped and the ridge line of which defines the transport and stitching line, and an essentially roof-shaped support, on which the sheet sections are transported astride.
- Delivery system: Machine component that transports the printed products after the stitching station with the stitching machine into the feed to the cutting apparatus. In the delivery system, the transport direction changes by 90 degrees, depending on the position of the cutting device, to the front or to the rear.
- Ejection phase, ejection: By means of a device, called an ejector, the printed product is lifted from the saddle chain until it is picked up by the conveyor belts in the delivery system and transported further in the delivery system.
- On-the-fly: Changes, for example of settings, positions of devices etc., possible during operation.
- MIS Management information system, job management system.

EP1593526 A1 discloses a saddle stitcher for brochures with a stitching machine, a delivery station loaded with the brochures on a step-by-step basis during normal operation, a front trimming knife arrangement defining a cutting plane for trimming the brochures along a respective target cutting line and with transport means components that, during normal operation, transport the brochures from the delivery station to the front trimming knife arrangement. The ejector device is controlled, independently of format, with regard to the transport components and transport device of the brochure in the area of the stitching machine. With such a saddle stitcher, it is not possible to process different printed products with digital printing, i.e. in particular successive printed products with different thicknesses and formats—without retooling—such that processing that is exact to the cycle and on-the-fly is not possible.

Typically, transport has so far been ensured by means of conveyor belts (top and bottom), which are driven by the stitching station. Different speeds of the conveyor belts are managed by a variator. This can be adjusted by hand, by means of a lever or with a motor.

The problems of this technical solution include the following: (1) settings that cannot be reproduced exactly and user intervention necessary due to the function; (2) the speed is constant during the entire transport path, which can often lead to transport marks on the surface of the printed product or to deformation of the spine of the booklet; (3) due to the mechanical coupling of the conveyor belts to the stitching station (the stitching station also rotates the conveyor belts), it is not possible to correct the position of the printed products (distance to the in-feed of the cutting device); and (4) an adjustment that is exact to the cycle is not possible.

SUMMARY

An embodiment of the present invention provides a saddle stitcher for printed products that has: a saddle chain; a stitching machine; a controller; an ejector; and a delivery system. The delivery system includes: at least one lower conveyor belt and one upper conveyor belt; and at least one deflection roller for the lower conveyor belt, the at least one deflection roller being arranged in a radius. The lower conveyor belt has a first controllable self-propelled drive.

The upper conveyor belt has a second controllable self-propelled drive. The controller is configured to separately control the first controllable self-propelled drive and the second controllable self-propelled drive. The controller is configured to provide a control that is exact to a cycle and is adjustable according to a thickness and a format of a respective printed product in a product flow.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
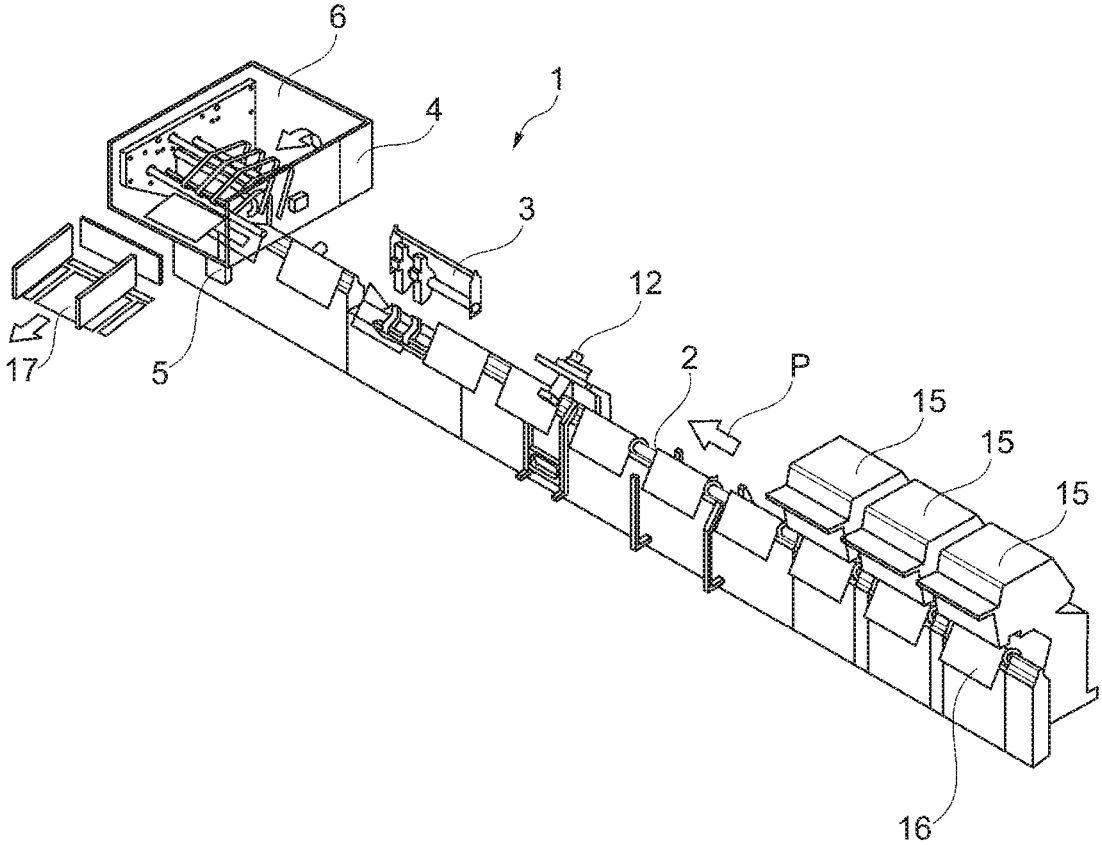
FIG. 1 shows a simplified representation of a saddle stitcher.

Embodiments of the present invention provide a saddle stitcher for printed products that overcomes the disadvantages of the prior art and is capable of processing product thicknesses that vary from cycle to cycle. This adjustment to the thickness variance can take place dynamically during operation and between two stitching processes. Embodiments also effectively prevent damage to the printed product in the delivery system caused by a different belt speed. Embodiments control the respective speed of the lower and/or upper conveyor belt in a manner that is exact to the cycle and on-the-fly. Printed products with different thicknesses and/or different formats are transported safely and gently according to the embodiments.

The invention relates to a saddle stitcher for printed products, which has at least the assemblies of saddle chain, stitching machine, controller, ejector, and delivery system. In embodiments, the delivery system has at least one lower conveyor belt and one upper conveyor belt as well as at least one deflection roller for the lower conveyor belt, and the at least one deflection roller is arranged in a radius In an embodiment of the invention, the lower conveyor belt 7 has a controllable self-propelled drive 10 and the upper conveyor belt 8 has a controllable self-propelled drive 11 and the controller 4 separately controls at least the self-propelled drive 10, 11. The control that is exact to the cycle is primarily adjustable to the thickness and the format of the respective printed product in the product flow.

The controller 4 is a control device customary for this purpose of use and has at least one customary microprocessor that, using software customary in this respect, makes it possible, in particular, to process different measurement data; and thus, to implement a customary control of controllable electrical components, such as a controllable electromotive drive, such as the self-propelled drives 10 and 11.

Through the deceleration and/or acceleration of the conveyor belts 7, 8 in this regard, in comparison to the stitching station/cut transport, a synchronized transfer is ensured. The controller 4 can use data that includes job data from the MIS or from a company's own job data system, for example the format data of the individual folded sheets, format data of the brochure, such as cut width and length, and a great deal of further data that is required to be able to implement a job for a printed product. Such data may be based on an international standard, such as the CIP 4.

Additionally or alternatively, the controller 4 can use data that had been generated in a manner that is exact to the cycle from measurement data of the current product process. In doing so, the control can generate data, for example from the data of the individual folded sheets and/or the brochure thickness. The control also recognizes machine data, such as the speed of the machine, production status, etc. On the basis of such values, the software of controller 4 calculates, in particular, the speeds of conveyor belts 7, 8.

The saddle stitcher in accordance with the invention can process product thicknesses (variable thickness) that vary from print product to print product (cycle to cycle), a requirement made by digital printing (each print product is unique).

The present invention deals in particular with the control of the speed of the lower conveyor belt 7 and/or the upper conveyor belt 8, which transport the brochure through the delivery system. The brochure is moved from the vertical axis to the horizontal axis with at least one deflection roller 9, which is arranged in a radius. If the brochure is within the range of the radius, the top belt speed can be increased and/or decreased depending on the product thickness, for example.

If the brochure is outside the radius range of at least one deflection roller 9, which can be calculated on the basis of the format size, synchronization between the lower conveyor belt 7 and the upper conveyor belt 8 can prevail once again. The motion sequence depends on various factors, such as the speed of the saddle chain 2, the thickness of the brochure and the format of the brochure.

Embodiments of the present invention make it possible to safely transfer the brochure from the ejector 5 to the delivery system 6, where the belt speed can be adjusted to the ejector speed. It is also possible to adjust the belt speed in connection with the brochure leaving the delivery system in order to optimize the transition to the feed of the cutting device.

Additional advantages of the invention, include: (1) with the self-propelled drives 10, 11 (servomotors), on-the-fly is possible for each printed product; (2) dynamically adjustable upper and lower belt speed; (3) technically simple solution because additional devices (such as a variator) are not required; (4) master-slave force equalization is enabled so that both motors of the self-propelled drives 10, 11 can be optimally loaded equally; (5) speed compensation between the lower conveyor belt 7 and the upper conveyor belt 8 for variable product thicknesses because the inside has to cover a path different than that of the outside (depending on product thickness); (6) independent of the speed of the saddle chain or the in-feed speed of the cutting device 17; (7) changes in speed are possible over the entire transport distance.

Sequence of a Process

During operation, the lower conveyor belt 7 and/or the upper conveyor belt 8 can be operated, in particular on the basis of format data, brochure thickness and machine speed, as described below in a), b), c) and d).

a) Speed Factor:

1. Product thickness determines speed factor between the lower conveyor belt 7 and the upper conveyor belt 8.
2. The torque of all drives is recorded at a constant production speed.
3. If the torques deviate from the expected value, the speed factor between the lower conveyor belt 7 and the upper conveyor belt 8 is adjusted accordingly.

b) Non-Synchronous Transfer from the Ejector to the Conveyor Belts:

1. If the saddle stitcher 1 stops, the ejection movement may be started shortly prior to standstill and a printed product may therefore be transported onto the stationary or almost stationary conveyor belts 7, 8.
2. In order to ensure that the printed product remains correctly positioned while the saddle stitcher 1 is at a standstill, the conveyor belts 7, 8 rotate a certain distance further.
3. This distance is compensated upon restart.

c) Synchronous Transfer #1 from the Ejector to the Conveyor Belts:

1. At normal speeds, the conveyor belts 7, 8 rotate synchronously with the product cycle, since the printed products are conveyed synchronously to the delivery system 6.
2. By means of the optical control device 13, such as sensors, photocells, camera systems or the like, the position in the delivery system is detected.
3. Any deviation from the target position (deviation due to slippage, mechanical adjustment, etc.) is compensated during the run.

d) Synchronous Transfer #2 from the Ejector to the Conveyor Belts:

1. In contrast to normal speeds, there are speed ranges in which the printed products are not conveyed synchronously into the delivery system.
2. The calculated deviation can be compensated by means of position compensation of the conveyor belts 7, 8. For example, the function of "halted operation," which is known for mechanical solutions.
3. By means of the optical control device 13, such as sensors, photocells, camera systems or the like, the position in the delivery system is detected.
4. Any deviation from the target position (deviation due to inaccurate calculation, slippage, mechanical adjustment, etc.) is compensated during the run.

It is preferred that a thickness gauge 12 is arranged in the product flow upstream of the stitching machine 3.

It is preferred that, in the horizontal area of the lower conveyor belt 7, preferably directly at the transition from the radius to the horizontal area, an optical control device 13 is arranged, which generates a measuring signal, which is transmitted to the controller 4. This optical control device 13 can be a standard measuring device in this respect, for example an optical sensor, a photocell or a camera system. Thus, deformations of the brochure can be detected, and the belt speeds of the lower and/or upper conveyor belt can be adjusted accordingly.

It is preferred that the controller 4 generates or possesses control data that is determined at least from data of a MIS 14 and/or the thickness gauge 12 and/or the optical control device 13. The product thickness of the printed product to be stitched can also be determined by measuring the product thickness during operation in order to determine any deviations from the target data from the MIS 14 (job management system) in order to be able to readjust.

It is preferred that the controller 4, which has at least one microprocessor, takes into account the torque measurement data of the self-propelled drives 10; 11 for controlling the speed of the conveyor belts 7; 8. The measurement of the torque in the individual self-propelled drives 10; 11 enables a correction of the speed of the conveyor belts 7; 8. The difference, in particular combined with the information of the product thickness, is used to influence the speed of the conveyor belts. This ensures that the forces on the top and bottom of the printed product are balanced across the entire transport path.

It is preferred that each of the self-propelled drives 10, 11 has at least one servomotor with a control or one asynchronous motor with a control.

Characteristics of embodiments of the invention are presented below with reference to the attached drawings, wherein such drawings do not limit the invention.

In this example, the saddle stitcher 1 in accordance with FIG. 1 includes three feeders 15, each of which transfers a sheet 16 to a saddle chain 2. The sheets 16 placed down and on top of each other in this manner together form the sheet sections, which are transported in one transport direction along the arrow P, which extends along the feeders 15 and beyond a stitching machine 3 to a delivery system 6.

In the transport direction after the stitching machine, 3 there is a brochure consisting of one or more sheets 16. The brochure is then lifted by the saddle chain 2 by an ejector 5 in the customary manner, and transferred to the delivery system 6. The brochure is transferred from delivery system 6 to a cutting apparatus 17.

The saddle stitcher 1 for printed products has at least the following assemblies: saddle chain 2, stitching machine 3, controller 4, ejector 5, and delivery system 6.

The delivery system 6 features at least one lower conveyor belt 7 and one upper conveyor belt 8 along with at least one deflection roller 9 for the lower conveyor belt 7. Three deflection rollers 9 are shown as examples in FIG. 2. The lower conveyor belt 7 has a controllable self-propelled drive 10, and the upper conveyor belt 8 has a controllable self-propelled drive 11. The controller 4 can separately control the self-propelled drives 10, 11. A thickness gauge 12 (FIG. 1) is arranged in the product flow upstream of the stitching machine 3, which transmits measurement data to the controller 4 in the customary manner.

Figure 2:
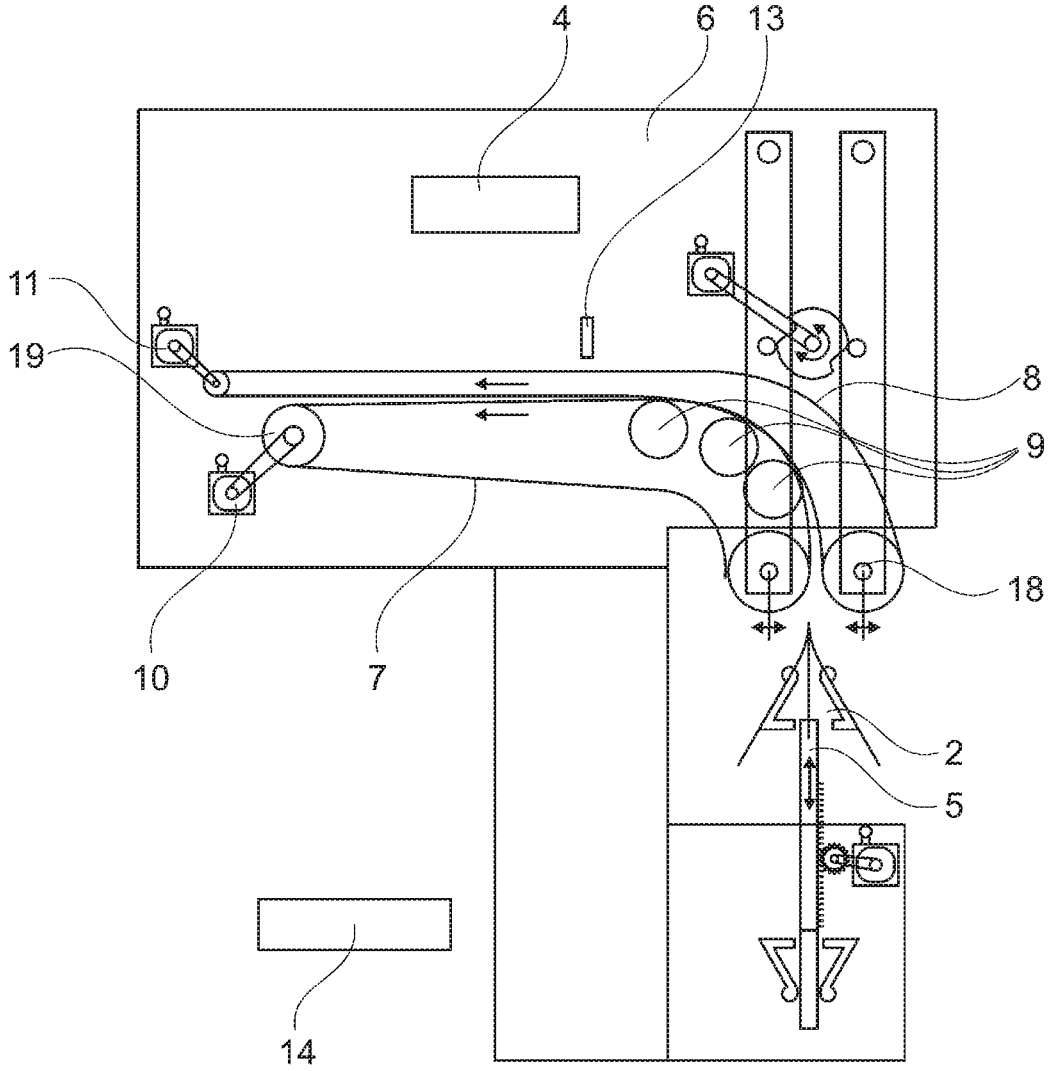
FIG. 2 shows a schematic side view of the saddle chain, the ejector and the delivery system.

FIG. 2 shows a schematic side view of the saddle chain 2, the ejector 5, and the delivery system 6. The delivery system 6 features at least one lower conveyor belt 7 and one upper conveyor belt 8 along with at least one deflection roller 9 for the lower conveyor belt 7. Three deflection rollers 9 are shown as examples in FIG. 2. The delivery system 6 may have other assemblies (e.g., such as those known from the state of the art, such as in-feed rollers 18 and drive rollers 19). The lower conveyor belt 7 has a controllable self-propelled drive 10 and the upper conveyor belt 8 has a controllable self-propelled drive 11. The gap between the in-feed rollers 18 can be changed, for example, depending on the product thickness.

In the horizontal area of the lower conveyor belt 7, directly at the transition from the radius to the horizontal area, an optical control device 13 is arranged; this generates a measuring signal that is transmitted to the controller 4.

The controller 4 controls the self-propelled drives 10, 11 separately. The controller 4 is a control device customary for this purpose of use and has at least one customary microprocessor that, using corresponding customary software, makes it possible, in particular, to process different measurement data, and thus to implement a customary control of controllable electrical components, such as a controllable electromotive self-propelled drive 10, 11. The controller 4 uses data that includes job data from the MIS 14 or from a company's own job data system, for example the format data of the individual folded sheets, format data of the brochure, such as cut width and length, and a great deal of further data that is required to be able to implement a job for a printed product.

Additionally or alternatively, the controller 4 can use data that had been generated in a manner that is exact to the cycle from measurement data of the current product process, as transmitted by the thickness gauge 12 (FIG. 1). Additionally or alternatively, the controller 4 can use torque measurement data from the self-propelled drives 10; 11 to control the speed of the conveyor belts 7; 8 and take such data into account. Each of the controllable self-propelled drives 10, 11 has at least one servomotor with a conventional control. Such self-propelled drives 10, 11 drive the drive roller 19 variably in the customary manner.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A saddle stitcher for printed products, the saddle stitcher comprising:

a saddle chain;

a stitching machine;

a controller;

an ejector; and a delivery system, comprising:

at least one lower conveyor belt and one upper conveyor belt; and at least one deflection roller for the lower conveyor belt, being arranged in a radius, wherein the lower conveyor belt has a first controllable self-propelled drive, wherein the upper conveyor belt has a second controllable self-propelled drive, wherein the controller is configured to separately control the first controllable self-propelled drive and the second controllable self-propelled drive, wherein the controller is configured to provide a control that is exact to a cycle and is adjustable according to a thickness and a format of a respective printed product in a product flow.

2. The saddle stitcher according to claim 1, wherein a thickness gauge is arranged in the product flow upstream of the stitching machine.

3. The saddle stitcher according to claim 1, wherein, in a horizontal area of the lower conveyor belt, an optical control device is arranged, the optical control device being configured to generate a measuring signal that is transmitted to the controller.

4. The saddle stitcher according to claim 1, wherein the controller generates or possesses control data that is determined at least from data of a management information system (MIS) and/or a thickness gauge and/or an optical control device.

5. The saddle stitcher according to claim 1, wherein the controller, which has at least one microprocessor, takes into account a torque measurement data of the first controllable self-propelled drive and the second controllable self-propelled drive for controlling a speed of the conveyor belts.

6. The saddle stitcher according to claim 1, wherein each of the first controllable self-propelled drive and the second controllable self-propelled drive has at least one servomotor with a control or one asynchronous motor with a control.

7. The saddle stitcher according to claim 1, wherein the controller takes into account torque measurement data from at least two deflection rollers for controlling speeds of the upper conveyor belt and the lower conveyor belt.

8. The saddle stitcher according claim 1, wherein the saddle stitcher is configured for digital printing.

9. The saddle stitcher according to claim 3, wherein the optical control device is arranged directly at the transition from the radius to the horizontal area.

10. The saddle stitcher according to claim 1, wherein the controller is configured to determine a speed factor between the lower conveyor belt and the upper conveyor belt based on product thickness.

11. The saddle stitcher according to claim 5, wherein the controller is configured to adjust a speed factor between the lower conveyor belt and the upper conveyor belt based on determining that a torque deviates from an expected value.

12. The saddle stitcher according to claim 3, wherein the controller is configured to compensate for a deviation from a printed product being outside a target position, the deviation being determined based upon the measuring signal.

13. The saddle stitcher according to claim 1, wherein the controller is configured to adjust its control signals based on detecting that a printed product in a current product flow has a different thickness or format than a previous printed product of a previous product flow.

* * * * *